US006907221B2

(12) United States Patent
Tanino et al.

(10) Patent No.: US 6,907,221 B2
(45) Date of Patent: Jun. 14, 2005

(54) HEAT FIXING DEVICE AND IMAGE FORMING APPARATUS

(75) Inventors: Ken Tanino, Ibaraki (JP); Yasuhiro Ohno, Ibaraki (JP); Shoukou Gon, Taakarazuka (JP); Kazuo Mohri, Itami (JP); Masami Miyazaki, Itami (JP); Makoto Fujii, Itami (JP); Eiichi Sano, Takarazuka (JP)

(73) Assignee: Minolta Company, Ltd., Osaka (JP)

( * ) Notice: Subject to any disclaimer, the term of this patent is extended or adjusted under 35 U.S.C. 154(b) by 27 days.

(21) Appl. No.: 10/446,770

(22) Filed: May 29, 2003

(65) Prior Publication Data

US 2004/0161271 A1 Aug. 19, 2004

(30) Foreign Application Priority Data

Feb. 14, 2003 (JP) ..... 2003-035920

(51) Int. Cl.[7] ..... G03G 15/20
(52) U.S. Cl. ..... 399/329
(58) Field of Search ..... 399/320, 328, 399/329, 330, 331, 332, 333, 334, 335, 336, 337, 338; 219/216

(56) References Cited

U.S. PATENT DOCUMENTS 5,124,755 A * 6/1992 Hediger ..... 399/329
5,970,301 A * 10/1999 De Cock ..... 399/328
6,721,532 B2 * 4/2004 Kosugi et al. ..... 219/216

FOREIGN PATENT DOCUMENTS

| | | | | |
|---|---|---|---|---|
| JP | 09-274401 | | 10/1997 | |
| JP | 09274401 | A * | 10/1997 | ..... G03G/15/20 |
| JP | 10207272 | A * | 8/1998 | ..... G03G/15/20 |
| JP | 10-333459 | | 12/1998 | |
| JP | 11174878 | A * | 7/1999 | ..... G03G/15/20 |
| JP | 2001-034094 | | 2/2001 | |

* cited by examiner

*Primary Examiner*—Arthur T. Grimley
*Assistant Examiner*—Ryan Gleitz
(74) *Attorney, Agent, or Firm*—Morrison & Foerster, LLP

(57) ABSTRACT

A heat fixing device for heat fixing a toner image to a receiving medium having a pair of fixing belts in an endless form; a pair of rotary members individually disposed on a respective inside circumference of the fixing belts and pressed against each other via the fixing belts; a pair of fixing members individually disposed on the respective inside circumference of the fixing belts and pressed against each other via the fixing belts; and a heating element for heating at least one of the fixing belts, wherein the fixing belts contact the rotary members and the fixing members only at a respective portion thereof via which the respective pair of rotary members and fixing members are pressed against each other.

14 Claims, 6 Drawing Sheets

PRIOR ART

HEAT FIXING DEVICE AND IMAGE FORMING APPARATUS

RELATED APPLICATION

The present invention is based on Japanese Patent Application No. 2003-35920, the content of which is incorporated by reference.

BACKGROUND OF THE INVENTION

1. Field of the Invention

The present invention relates to a heat fixing device for use in image forming apparatuses, such as copying machines, printers and the like, for fixing a toner image to a receiving medium. The invention is characterized by an increased length of a nip portion for heat fixing the toner image to the receiving medium and by an arrangement directed to an efficient use of heat.

2. Description of the Related Art

Conventionally, the image forming apparatuses, such as copying machines and printers, operate to transfer the toner image onto the receiving medium and to fix the toner image to the receiving medium by means of a fixing device.

Heretofore, widely used fixing devices have been arranged as shown in FIG. 1. That is, a receiving medium 1 supplied with a toner t is introduced to place between a pair of fixing rollers 2, 3 which cooperate with each other to fix the toner t to the receiving medium 1. The above fixing device includes heating elements 4, 5 disposed in the respective fixing rollers 2, 3 for ensuring that the toner t is fully fixed to the receiving medium 1. Furthermore, the fixing device employs the fixing rollers 2, 3 constructed such that a core 2*a*, 3*a* formed of a metal is formed with an elastic layer 2*b*, 3*b* on an outer periphery thereof, the elastic layer formed from an elastic material such as rubber. As heated by the heating elements 4, 5, the fixing rollers 2,3 are pressed against each other so as to define the nip portion of an increased length between the elastic layers 2*b*, 3*b* overlaid on the outer peripheries of the fixing rollers 2, 3. Thus is ensured that the toner t is subjected to sufficient heat and pressure to fix the toner t to the receiving medium 1.

More recently, a demand exists for further speed-up of the above image forming apparatuses. This dictates the need for quick and positive fixing of the toner t to the receiving medium 1. In a full-color image forming apparatus, on the other hand, toners t of multiple colors are supplied to the receiving medium 1 to form thereon a thick layer of the toners t, which need be fully fixed to the receiving medium 1.

In order to permit the fixing device to fix the toner t to the receiving medium 1 in a quick and positive manner or to fully fix the thick layer of the toners t to the receiving medium 1, the fixing rollers 2, 3 need to define therebetween an even longer nip portion where the toner t is heated and pressurized.

As an approach to increase the length of the nip portion defined between the fixing rollers 2, 3 it may be contemplated to increase the diameter of the fixing rollers 2, 3 or to increase the thickness of the elastic layers 2*b*, 3*b* overlaid on the outer peripheries of the fixing rollers 2, 3.

Unfortunately, in a case where the fixing rollers 2, 3 are increased in the diameter, as described above, the fixing device is also increased in size or the receiving medium 1 is more liable to wind about the fixing roller 2 contacting the toner t on the receiving medium. In a case where the elastic layers 2*b*, 3*b* formed on the outer peripheries of the fixing rollers 2, 3 are increased in the thickness, on the other hand, heat transfer to outside surfaces of the fixing rollers 2, 3 is lowered so that it takes more time and a substantial quantity of electric power to sufficiently raise the temperature of the outside surfaces of the fixing rollers 2, 3. This results in an increased running cost.

More recently, there has been proposed a heat fixing device arranged as follows. A pair of fixing belts drivably looped about a respective pair of rollers are heated by means of heating elements, while a receiving medium supplied with a toner is introduced into a nip portion defined between a pair of fixing belt portions brought into tight contact by the roller pairs, the nip portion serving to heat and pressurize the toner for fixing the toner to the receiving medium (see, for example, JP-A No. 9-274401).

In such a heat fixing device, however, the fixing belts are driven as looped about outer peripheries of the respective pair of rollers. Therefore, the fixing belt has an increased contact area with the roller pair so that the heat of the fixing belt applied by the heating element is detrimentally absorbed by the rollers. Consequently, the heating element is decreased in the efficiency of heating the fixing belt, requiring a substantial quantity of electric power for sufficiently heating the fixing belt.

SUMMARY OF THE INVENTION

The invention is directed to a solution to the above problem encountered by the image forming apparatuses, such as copying machines and printers, during the fixing of the toner image to the receiving medium.

Specifically, an object of the invention is to provide a heat fixing device wherein a receiving medium supplied with a toner is introduced into a nip portion defined between a pair of fixing belt portions in tight contact so that the toner is fixed to the receiving medium as heated and pressurized in the nip portion, the heat fixing device designed to reduce the absorption of the heat of the fixing belts thereby achieving an efficient heating of the fixing belts by means of a heating element and obviating the temperature drop of the fixing belts.

Another object of the invention is to permit the above heat fixing device to fix the toner image to the receiving medium in an efficient and proper manner.

According to the invention, a heat fixing device for heat fixing a toner image to a receiving medium comprises: a pair of fixing belts in an endless form; a pair of rotary members individually disposed on a respective inside circumference of the fixing belts and pressed against each other via the fixing belts; a pair of fixing members individually disposed on the respective inside circumference of the fixing belts and pressed against each other via the fixing belts; and a heating element for heating at least one of the fixing belts, wherein the fixing belts contact the rotary members and the fixing members only at a respective portion thereof via which the respective pair of rotary members and fixing members are pressed against each other.

According to the heat fixing device of the invention, at least one of the fixing belts is heated by the heating element, while the toner image is heat fixed to the receiving medium by heating and pressurizing the receiving medium with the toner image transferred thereto in a nip portion defined between the respective pair of rotary members and fixing members pressed against each other via the fixing belts, the rotary members and fixing members disposed on the respective inside circumference of the fixing belts. Such an arrangement ensures that the receiving medium with the toner image transferred thereto is sufficiently heated and pressurized in the nip portion defined between the respective pair of rotary members and fixing members, whereby the toner image is fully fixed to the receiving medium.

According to the heat fixing device of the invention, the fixing belts contact the rotary members and the fixing members at a respective portion thereof via which the respective pair of rotary members and fixing members are pressed against each other. Accordingly, the fixing belt has a decreased contact area with the rotary member and the fixing member so that the rotary member and fixing member absorb less heat from the fixing belt thus heated by the heating element. As a result, the heating element is increased in the efficiency of heating the fixing belt, while the fixing belt has such a consistent temperature as to permit the toner image to be fixed to the receiving medium in a consistent manner.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

A heat fixing device according to one embodiment of the invention will hereinbelow be described in details with reference to the accompanying drawings.

Figure 1:
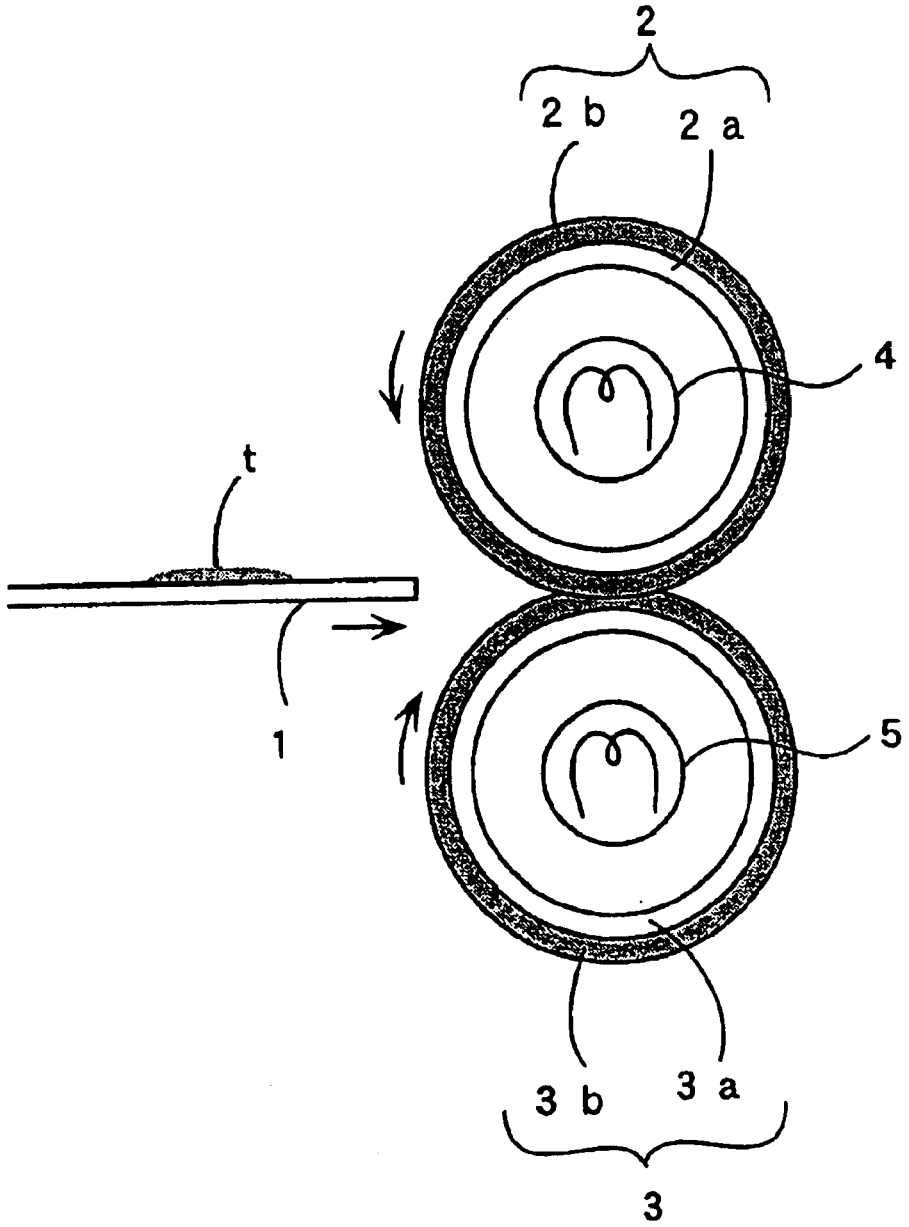
FIG. 1 is a schematic diagram illustrating a conventional fixing device wherein a receiving medium supplied with a toner is introduced to place between a pair of fixing rollers for fixing the toner to the receiving medium.
Figure 2:
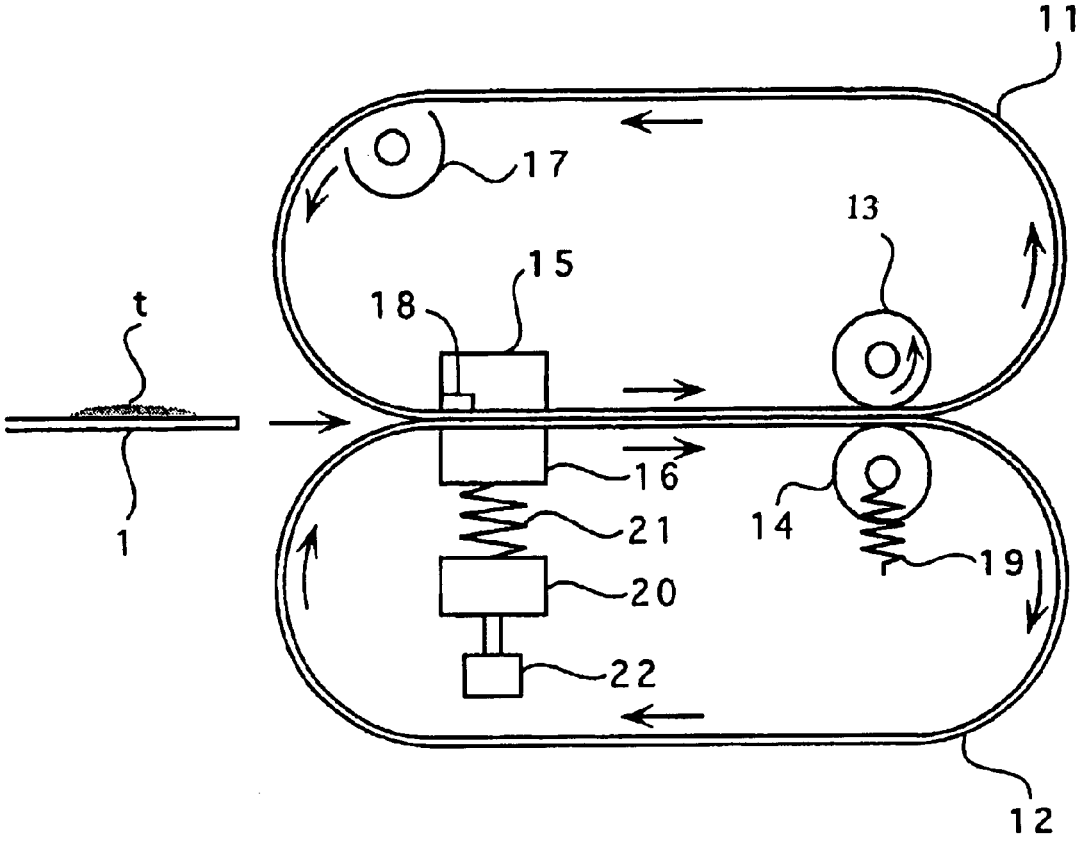
FIG. 2 is a schematic diagram illustrating a heat fixing device according to an embodiment of the invention.

As shown in FIG. 2 the heat fixing device of the embodiment includes a pair of endless fixing belts 11, 12; a pair of rotary members 13, 14 disposed on a respective inside circumference of the fixing belts 11, 12 and pressed against each other via the fixing belts 11, 12; and a pair of fixing members 15, 16 disposed on the respective inside circumference of the fixing belts 11, 12 and pressed against each other via the fixing belts 11, 12. The fixing belts 11, 12 contact the rotary members 13, 14 and the fixing members 15, 16 on the inside circumferences thereof only at a respective portion thereof via which the respective pair of rotary members 13, 14 and fixing members 15, 16 are pressed against each other.

A halogen lamp 17 as a heating element 17 is disposed at place within the inside circumference of the upper fixing belt 11 coming into contact with the toner t fed on the receiving medium 1. The halogen lamp 17 serves to heat the upper fixing belt 11, whereas the temperature of the fixing belt 11 is sensed by a temperature sensor 18 provided at the fixing member 15.

In this embodiment, the rotary members 13, 14 and the fixing members 15, 16 are disposed on the respective inside circumference of the fixing belts 11, 12 in the following manner. That is, the fixing members 15, 16 are located on an in-feed side to which the receiving medium 1 supplied with the toner t is delivered, whereas the rotary members 13, 14 are located on a discharge side from which the receiving medium 1 with the toner t fixed thereto is discharged.

The rotary member 13 disposed on the inside circumference of the upper fixing belt 11 is rotated thereby driving the fixing belts 11, 12 and also driving the rotary member 14 into rotation, which is disposed on the lower fixing belt 12. In the arrangement wherein the pair of fixing members 15, 16 are located on the side to which the receiving medium 1 is delivered whereas the pair of rotary members 13, 14 are located on the side from which the receiving medium 1 is discharged, the fixing belts 11, 12 may be driven properly in association with the rotation of the rotary members 13, 14.

In order to hold the pair of rotary members 13, 14 pressed against each other via the fixing belts 11, 12 the rotary member 14 on the inside circumference of the lower fixing belt 12 is biased upward against the counterpart by means of a spring 19. In order to hold the pair of fixing members 15, 16 pressed against each other via the fixing belts 11, 12, the fixing member 16 on the inside circumference of the lower fixing belt 12 is biased upward against the counterpart by means of a spring 21 mounted to a base 20.

In the above arrangement wherein the pair of rotary members 13, 14 and the pair of fixing members 15, 16 are independently brought into the pressed relation, individual pressures between the rotary members 13, 14 and between the fixing members 15, 16 may be suitably regulated according to the type of a used toner t.

When the pressure between the fixing members 15, 16 is increased, the toner t is fully fixed to the receiving medium 1 as pressed between the fixing members 15, 16 so that an image having a good gloss may be obtained. When, on the other hand, the pressure between the rotary members 13, 14 is increased, the toner t is fully fixed to the receiving medium 1 just as when pressed between the fixing members 15, 16. Furthermore, the receiving medium 1 may suitably be separated from the fixing belts 11, 12 when discharged.

A pressure release unit 22 is provided for moving up or down the base 20 so as to release the pair of fixing members 15, 16 from the pressed relation. When the heat fixing device is at rest or when the receiving medium 1 becomes jammed in a nip portion defined between the fixing member pair 15, 16 and the rotary member pair 13, 14, the pressure release unit 22 moves down the base 20 for releasing the pair of fixing members 15, 16 from the pressed relation. This arrangement facilitates the removal of the jammed receiving medium 1. In this case, the pair of rotary members 13, 14 stay in the pressed relation. However, the rotary members 13, 14 are rotatable and hence, difficulty in removing the receiving medium 1 from between the rotary member pair is rarely encountered. Furthermore, when the pair of rotary members 13, 14 are held in the pressed relation, the fixing belts 11, 12 are prevented from being displaced during the removal of the receiving medium 1.

The heat fixing device of the embodiment operates as follows to fix the toner t to the receiving medium 1. First, the upper fixing belt 11 is heated by means of the aforesaid halogen lamp 17 for a given period of time, say 10 seconds or so. Subsequently, an output to the halogen lamp 17 is decreased while the rotary member 13 on the inside circumference of the upper fixing belt 11 is caused to rotate thereby driving the pair of fixing belts 11, 12.

Where the upper fixing belt 11 is heated before the pair of fixing belts 11, 12 are driven into rotation, the heat of the fixing belt 11 is transferred to the rotary member 13 the fixing member 15 and the lower fixing belt 12 which are in contact with the upper fixing belt 11. Thus, the rotary member 13, fixing member 15 and lower fixing belt 12 are heated. In the meantime, the heat of the lower fixing belt 12 thus heated is transferred to the rotary member 14 and the fixing member 16 disposed on the inside circumference thereof, so that these members are also heated.

The aforesaid temperature sensor 18 takes measurement on the temperature of the upper fixing belt 11 at a portion thereof via which the fixing members 15, 16 are pressed against each other. After the temperature thus taken reaches a predetermined level say 160° C. or so, the receiving medium 1 supplied with the toner t is introduced to place between the pair of fixing belts 11, 12.

At place where the pair of fixing members 15, 16 are pressed against each other, the receiving medium 1 is subjected to the heat and pressure as held between the fixing belt pair 11, 12. As held between the pair of fixing belts 11, 12, the receiving medium 1 is advanced to place where the pair of rotary members 13, 14 are pressed against each other. At this place, the receiving medium 1 is further heated and pressurized for fixing the toner t thereto. Subsequently, the receiving medium 1 with the toner t thus fixed thereto is discharged from between the pair of fixing belt portions 11, 12 via which the pair of rotary members 13, 14 are pressed against each other.

Figure 3:
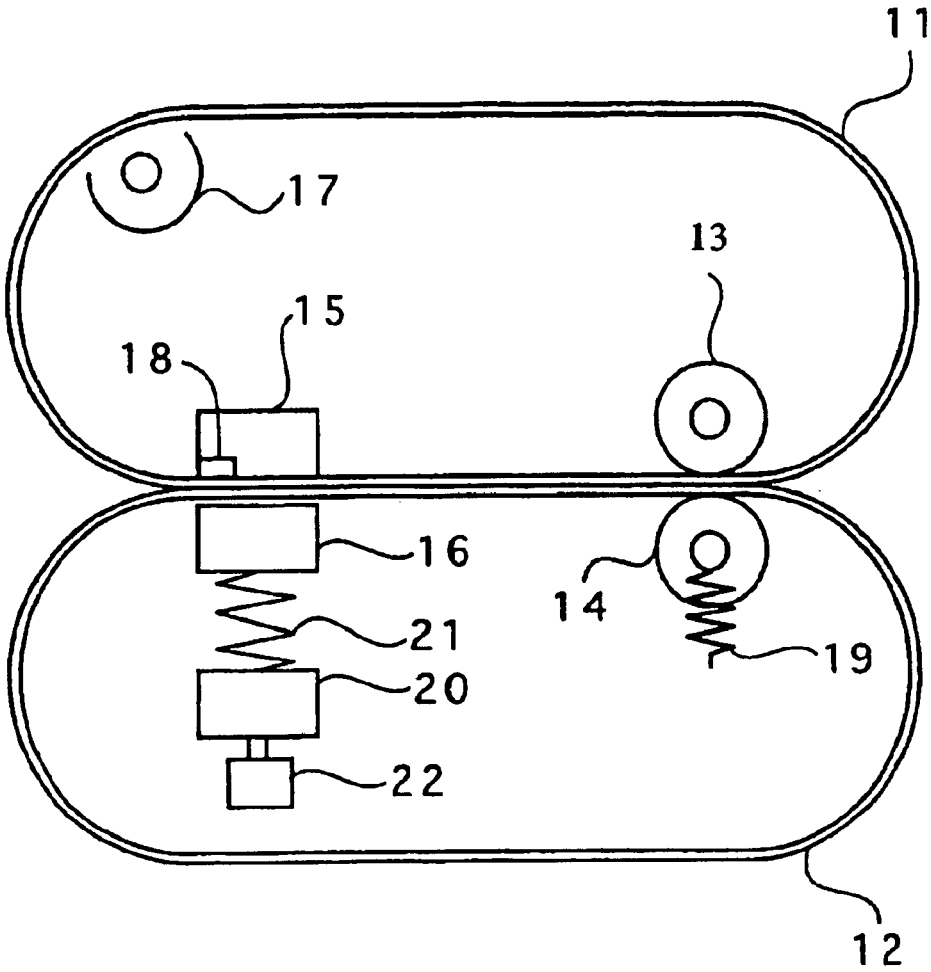
FIG. 3 is a schematic diagram of the heat fixing device according to the above embodiment for illustrating a state where a pair of fixing members are released from pressed relation by a pressure release unit.

The aforesaid operations,for fixing the toner t to the receiving medium 1 are carried out for a predetermined number of cycles. After the lapse of a predetermined period of time (e.g., 30 minutes), the heating by means of the halogen lamp 17 is terminated. At the same time, the rotation of the rotary member 13 is stopped while the pressure release unit 22 moves down the base 20 to release the pair of fixing members 15, 16 from the pressed relation, as shown in FIG. 3.

Thus, the deformation or the like of the fixing belts 11, 12 is prevented by releasing the fixing member pair 15, 16 from the pressed relation by means of the pressure release unit 22.

As described above, the heat fixing device of the embodiment is arranged such that the fixing belts 11, 12 contact the rotary members 13, 14 and the fixing members 15, 16 on the inside circumferences thereof only at a respective portion thereof via which the respective pair of rotary members 13, 14 and fixing members 15, 16 are pressed against each other. Therefore, the fixing belts 11, 12 contact the rotary members 13, 14 and the fixing members 15, 16 at reduced contact areas so that the rotary members 13, 14 and the fixing members 15, 16 absorb less heat from the fixing belts 11, 12. As a result, the temperature drop of the fixing belts 11, 12 is suppressed.

In the heat fixing device of the embodiment, the fixing belts 11, 12 may be formed from, for example, a resin such as thermosetting polyimide, thermoplastic polyimide, polyamide and polyamideimide; or a metal such as nickel, stainless steel and copper. In the light of enhancing the heat resistance, wear resistance, chemical resistance and the like, the fixing belts 11, 12 may preferably be formed from a thermosetting polyimide. From a standpoint of increasing thermal conductivity, it is preferred to form the fixing belts 11, 12 from a metal such as nickel or stainless steel.

If the fixing belts 11, 12 are too great in thickness, the rate of heating the fixing belts 11, 12 is lowered so that it takes longer to heat the fixing belts sufficiently. Therefore, it is preferred that the fixing belts 11, 12 have the minimum possible thickness that a sufficient strength is ensured. Thus, the fixing belts may normally have a thickness of not more than 500 $\mu$m, or preferably of not more than 300 $\mu$m.

Figure 4:
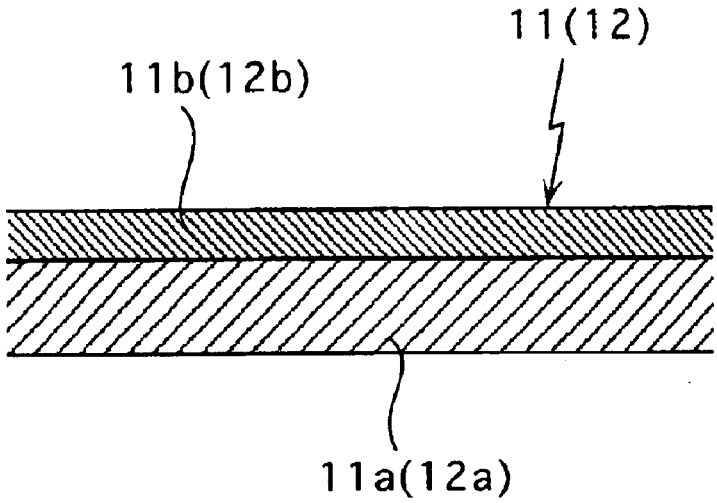
FIG. 4 is a sectional view showing a laminated structure of a first exemplary fixing belt used in the heat fixing device according to the embodiment.

As shown in FIG. 4, the fixing belts 11, 12 may be constructed such that a separator layer 11*b*, 12*b* is formed on an outer periphery of a belt base 11*a*, 12*a* formed from any of the above materials. Such a belt construction not only prevents the toner t from adhering to the outer periphery of the fixing belt 11, 12 but also permits the receiving medium 1 with the toner t fixed thereto to be favorably separated from the fixing belt 11, 12. The thickness of the separator layer 11*b*, 12*b* may normally be in the range of 5 to 100 $\mu$m, or preferably of 10 to 30 $\mu$m.

The separator layers 11*b*, 12*b* may be formed from a material suffering less adhesion of the toner t, such as a fluorine resin and a fluorine rubber. It is preferred to use the fluorine resin.

Examples of a usable fluorine resin include perfluoroalkoxy fluorine resin (PFA), polytetrafluoroethylene (PTFE), tetrafluoroethylene-hexafluoropropylene copolymer (FEP), polyethylene-tetrafluoroethylene copolymer (ETFE), polyvinylidene fluoride (PVDF), polychlorotrifluoroethylene (PCTFE), polyvinyl fluoride (PVF) and the like. Examples of a usable fluorine rubber include vinylidene fluoride rubbers, fluorosilicone rubbers, tetrafluoroethylene-propylene rubbers, tetrafluoroethylene-perfluorovinylether rubbers, tetrafluoroethylene-perfluoro rubbers and the like.

Figure 5:
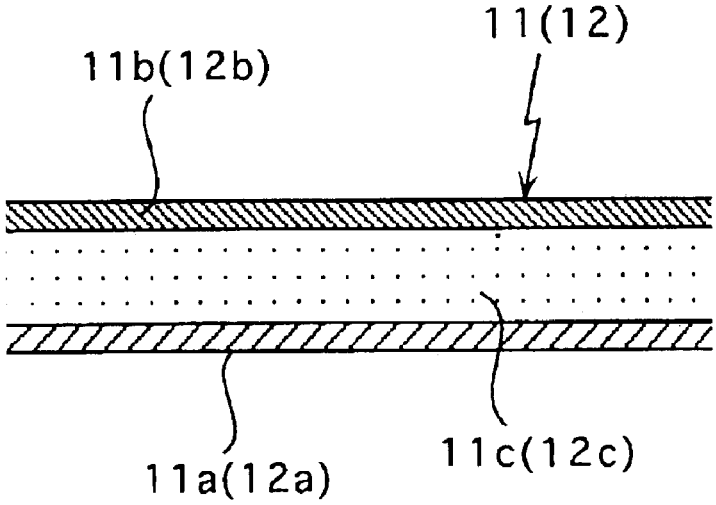
FIG. 5 is a sectional view showing a laminated structure of a second exemplary fixing belt used in the heat fixing device according to the embodiment.

As shown in FIG. 5, the fixing belt 11, 12 may have a structure wherein an elastic layer 11*c*, 12*c* is interposed between the belt base 11*a*, 12*a* and the separator layer 11*b*, 12*b*, which are each formed from the aforementioned material. Such a belt construction permits the fixing belt 11, 12 to suitably adhere to the toner t on the receiving medium 1 thereby obviating the occurrence of inconsistent toner fixing. Furthermore, the belt construction also provides for a stable conveyance of the receiving medium 1. If the elastic layer 11*c*, 12*c* is too great in thickness, too much time is required for sufficiently heating the fixing belt 11, 12. Therefore, the elastic layer may normally have a thickness of not more than 500 $\mu$m or preferably of not more than 250 $\mu$m. If, on the other hand, the elastic layer 11*c*, 12*c* is too small in thickness, the elastic layer 11*c*, 12*c* is unable to fully present the aforementioned effect. Therefore, it is more preferred that the thickness of the elastic layer 11*c*, 12*c* is in the range of 100 to 200 $\mu$m.

In the case where the fixing belt 11 is heated by means of the halogen lamp 17, it is preferred to increase the radiation absorptivity of the fixing belt 11 for quick heating of the fixing belt 11. Hence, it is favorable to employ a fixing belt having a radiation absorptivity of at least 80%, or more preferably of at least 90%.

In order to increase the radiation absorptivity of the fixing belt 11, the fixing belt 11 may be formed from a metal such as nickel or stainless steel, or otherwise, a coating solution having a radiation-absorbing property may be applied to the inside circumference of the fixing belt 11. Alternatively, radiation-absorbing particles such as carbon black, graphite, iron black, ferrite, copper oxide, cobalt oxide or iron red may be dispersed in the fixing belt 11.

The following experiment was conducted on the fixing belt 11 having the structure wherein the elastic layer 11*c* and the separator layer 11*b* were laminated on the belt base 11*a*, as shown in FIG. 5. The experiment was to determine which of the belt base 11*a*, the elastic layer 11*c* and the separator layer 11*b* should be increased in the radiation absorptivity in order to achieve the most efficient heating of the fixing belt 11 by means of the halogen lamp 17.

In this experiment, the following fixing belts were prepared. A fixing belt A had carbon black dispersed only in the belt base, presenting an overall radiation absorptivity of 99%. A fixing belt B had carbon black dispersed only in the separator layer, presenting an overall radiation absorptivity of 99%. A fixing belt B had carbon black dispersed only in the elastic layer, presenting an overall radiation absorptivity of 80%. A fixing belt D had carbon black dispersed in the whole body thereof, presenting an overall radiation absorptivity of 99%. A fixing belt E was free from carbon black. The overall radiation absorptivity of this fixing belt was 25%.

A respective inside circumference of the above fixing belts A to D was irradiated with light from the halogen lamp for heating the respective fixing belts A to D. The fixing belts A to D were each determined for the average heating rate (° C./sec) during a period of time that a surface temperature thereof was raised from 50° C. to 160° C. The results are listed in Table 1 as below.

TABLE 1

| FIXING BELT | CARBON-BLACK CONTAINING PORTION | RADIATION ABSORP-TIVITY (%) | HEATING RATE (° C./sec) |
|---|---|---|---|
| A | BELT BASE | 99 | 10 |
| B | SEPARATOR LAYER | 99 | 12 |
| C | ELASTIC LAYER | 80 | 13 |
| D | WHOLE BODY OF FIXING BELT | 99 | 10 |
| E | ABSENT | 25 | 7 |

As seen from the results, the heating rate was dramatically improved in the fixing belt C wherein the radiation-absorbing particles of carbon black were dispersed in the elastic layer alone for increasing the radiation absorptivity thereof. This indicates that it is preferred to increase the radiation absorptivity of the elastic layer.

Figure 6:
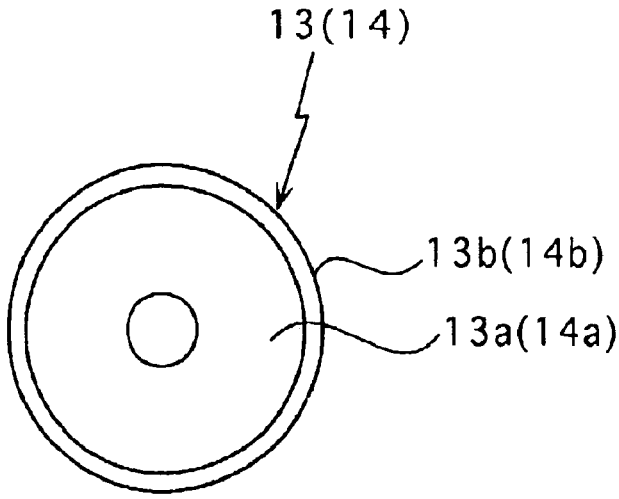
FIG. 6 is a side view showing an example of a rotary member used in the heat fixing device according to the embodiment.

The heat fixing device of the embodiment may employ the rotary members 13, 14 constructed such that a metal roller 13*a*, 14*a* such as formed of iron is formed with a surface layer 13*b*, 14*b* on an outer periphery thereof, as shown in FIG. 6.

If the rotary members 13, 14 are too great in diameter, the rotary members 13, 14 are increased in heat capacity so as to absorb more heat of the fixing belts 11, 12. In addition, such rotary members entail a problem that the receiving medium 1 is less prone to separate from the fixing belts 11, 12 when discharged from therebetween. If, on the other hand, the rotary members 13, 14 are too small in diameter, the rotary members have difficulty in driving the fixing belts 11, 12. Accordingly, it is preferred that the diameter of the rotary members 13, 14 is in the range of 8 to 20 mm.

The surface layers 13*b*, 14*b* overlaid on the outer peripheries of the rotary members 13, 14 may be formed from a material having a high heat resistance and such a high friction coefficient as to permit the fixing belts 11, 12 to be properly driven by the rotation of the rotary members 13, 14. Examples of a usable material for the surface layer include silicone rubbers, ceramic materials, polyimide resins and the like.

Figure 7:
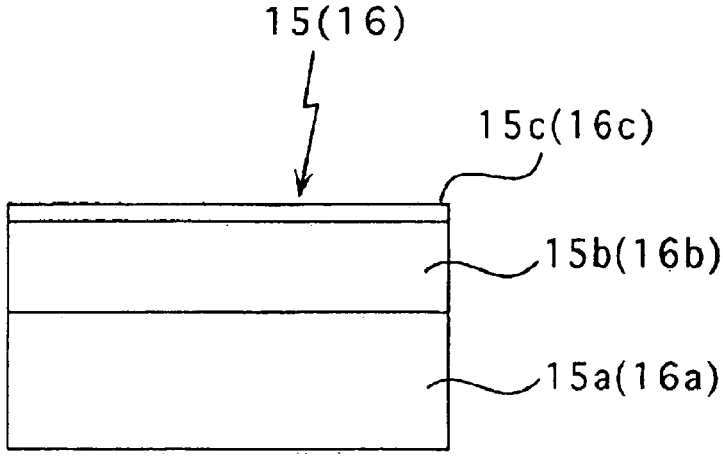
FIG. 7 is a sectional view showing a laminated structure of a first exemplary fixing member used in the heat fixing device according to the embodiment.

In the heat fixing device of the embodiment, the aforesaid fixing member 15, 16 may be constructed such that a pad support member 15*a*, 16*a* is laminated with a pad member 15*b*, 16*b*, which, in turn, is laminated with a low-friction layer 15*c*, 16*c* for reducing friction to the fixing belt 11, 12, as shown in FIG. 7 for example.

The above pad support members 15*a*, 16*a* may be formed from a material including a metal such as stainless steel and iron, a hard resin and the like, such that the fixing members 15, 16 may be pressed against each other at a consistent pressure.

Examples of a suitable material for the pad members 15*b*, 16*b* include resins, rubbers, foamed rubbers, ceramics, metals and the like. In a case where the pad members are formed from an elastic material such as rubber, the fixing members 15, 16 may be pressed against each other at a consistent pressure. In a case where, on the other hand, the pad members are formed from a hard material such as ceramic or metal, the fixing members 15, 16 may be pressed against each other at an increased pressure so that the toner t is more positively fixed to the receiving medium 1.

The above low-friction layer 15*c*, 16*c* may preferably be formed from a material having a low friction coefficient and an excellent heat resistance. Examples of a usable material include fluorine resins, ceramics, glass cloth, polymides and the like. Above all, a fluorine resin is preferred. Although the embodiment has the arrangement wherein the low-friction layer 15*c* 16*c* is overlaid on the pad member 15*b*, 16*b*, it is also possible to interpose a sheet formed from the above low-friction material between the fixing belt 11, 12 and the pad member 15*b*, 16*b*.

Examples of a usable fluorine resin include perfluoroalkoxy fluorine resin (PFA), polytetrafluoroethylene (PTFE), tetrafluoroethylene-hexafluoropropylene copolymer (FEP), polyethylene-tetrafluoroethylene copolymer (ETFE), polyvinylidene fluoride (PVDF), polychlorotrifluoroethylene (PCTFE), polyvinyl fluoride (PVF) and the like. Such fluorine resins may be added with a material having a good wear resistance. In addition, the glass cloth or polyimide, having a good wear resistance, may be surface-coated with such a fluorine resin.

Figure 8:
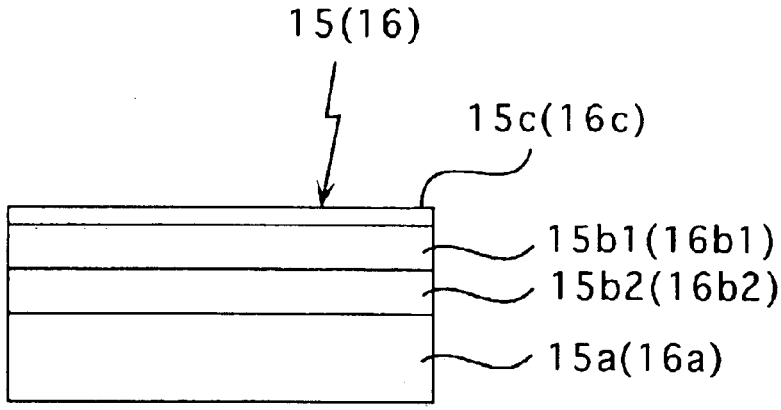
FIG. 8 is a sectional view showing a laminated structure of a second exemplary fixing member used in the heat fixing device according to the embodiment.

As shown in FIG. 8, the above pad member 15*b*, 16*b* may also comprise a lamination of a high-thermal-conductivity layer 15*b*1, 16*b*1 and a low-thermal-conductivity layer 15*b*2, 16*b*2, the high-thermal-conductivity layer 15*b*1, 16*b*2 adjoining the low friction layer 15*c*, 16*c*. Such a construction is adapted for quick heat transfer in the surface of the pad member 15*b*, 16*b* so that the fixing member 15, 16 is decreased in the variations of the surface temperature thereof. This leads to a consistent heating of the receiving medium 1 supplied with the toner t so that the occurrence of inconsistent toner fixing is obviated. In addition, the low-thermal-conductivity layer 15*b*2, 16*b*2 suppresses the heat transfer from the fixing belt 11, 12 to the pad support member 15*a*, 16*b* and hence, the heat released via the fixing member 15, 16 is decreased.

The high-thermal-conductivity layers 15*b*1, 16*b*1 may be formed from a material having a thermal conductivity of at least $0.6\times10^{-3}$ cal/cm·sec·° C. Examples of such a material include silicone rubbers, metals, perfluoroalkoxy fluorine resin (PFA) and the like. On the other hand, the low-thermal-conductivity layers 15*b*2, 16*b*2 may be formed from a material having a thermal conductivity of $0.5\times10^{-3}$ cal/cm·sec·° C. or less. Examples of such a material include foamed silicone rubbers, ceramics and the like.

Figure 9:
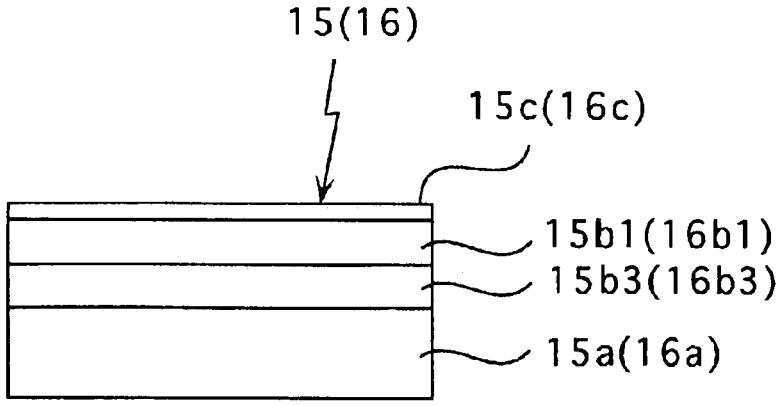
FIG. 9 is a sectional view showing a laminated structure of a third exemplary fixing member used in the heat fixing device according to the embodiment.

The aforesaid pad member 15*b*, 16*b* may have an alternative structure, as shown in FIG. 9, wherein the high-thermal-conductivity layer 15*b*1, 16*b*1 is laminated to a heat generating layer 15*b*3, 16*b*3, which generates heat for heating the high-thermal-conductivity layer 15*b*1, 16*b*1.

Although the present invention has been fully described by way of examples, it is noted that various changes and modifications will be apparent to those skilled in the art.

Therefore, unless otherwise such changes and modifications depart from the scope of the invention, they should be construed as being included therein.

What is claimed is:

1. A heat fixing device for heat fixing a toner image to a receiving medium comprising:

a pair of fixing belts in an endless form;

a pair of rotary members individually disposed on a respective inside circumference of the fixing belts and pressed against each other via the fixing belts;

a pair of non-rotatable fixing members individually disposed on the respective inside circumference of the fixing belts and pressed against each other via the fixing belts; and a heating element for heating at least one of the fixing belts, wherein the fixing belts contact the rotary members and the fixing members only at a respective portion thereof via which the respective pair of rotary members and fixing members are pressed against each other.

2. The heat fixing device as claimed in claim 1, wherein the pair of fixing members are located on a side to which the receiving medium is delivered, whereas the pair of rotary members are located on a side from which the receiving medium is discharged.

3. The heat fixing device as claimed in claim 1, further comprising a pressure release unit for releasing the pair of fixing members from a pressed relation.

4. The heat fixing device as claimed in claim 1, wherein the heating element is an optical heating element disposed at place within the inside circumference of the fixing belt.

5. The heat fixing device as claimed in claim 4, wherein the fixing belt absorbs light from the optical heating element at a radiation absorptivity of at least 80%.

6. The heat fixing device as claimed in claim 4, wherein the fixing belt comprises a belt base disposed on an inside-circumference-side thereof, and an elastic layer and a separator layer laminated on the belt base, and wherein the elastic layer has a higher radiation absorptivity than the belt base and the separator layer.

7. The heat fixing device as claimed in claim 1, wherein the fixing member has a structure wherein a high-thermal-conductivity layer and a low-thermal-conductivity layer are laminated, and wherein the high-thermal-conductivity layer is located on a side closer to the fixing belt.

8. An image forming apparatus including a heat fixing device for heat fixing a toner image to a receiving medium, the apparatus comprising:

a pair of fixing belts in an endless form;

a pair of rotary members individually disposed on a respective inside circumference of the fixing belts and pressed against each other via the fixing belts;

a pair of non-rotatable fixing members individually disposed on the respective inside circumference of the fixing belts and pressed against each other via the fixing belts; and a heating element for heating at least one of the fixing belts, wherein the fixing belts contact the rotary members and the fixing members only at a respective portion thereof via which the respective pair of rotary members and fixing members are pressed against each other.

9. The image forming apparatus as claimed in claim 8, wherein the pair of fixing members are located on a side to which the receiving medium is delivered, whereas the pair of rotary members are located on a side from which the receiving medium is discharged.

10. The image forming apparatus as claimed in claim 8, further comprising a pressure release unit for releasing the pair of fixing members from a pressed relation.

11. The image forming apparatus as claimed in claim 8, wherein the heating element is an optical heating element disposed at place within the inside circumference of the fixing belt.

12. The image forming apparatus as claimed in claim 11, wherein the fixing belt absorbs light from the optical heating element at a radiation absorptivity of at least 80%.

13. The image forming apparatus as claimed in claim 11, wherein the fixing belt comprises belt base disposed on an inside-circumference-side thereof, and an elastic layer and a separator layer laminated on the belt base, and wherein the elastic layer has a higher radiation absorptivity than the belt base and the separator layer.

14. The image forming apparatus as claimed in claim 8, wherein the fixing member has a structure wherein a high-thermal-conductivity layer and a low-thermal-conductivity layer are laminated, and wherein the high-thermal-conductivity layer is located on a side closer to the fixing belt.

* * * * *